US005290215A

United States Patent [19]

Lin

[11] Patent Number: 5,290,215

[45] Date of Patent: Mar. 1, 1994

[54] ABDOMINAL EXERCISE BENCH

[76] Inventor: Sheng H. Lin, No. 15, Lane 142, Chorng Shyue Road, Tainan, Taiwan

[21] Appl. No.: 23,085

[22] Filed: Feb. 26, 1993

[51] Int. Cl.[5] ..... A63B 26/00

[52] U.S. Cl. ..... 482/140; 482/139; 482/145

[58] Field of Search ..... 482/140, 145, 139, 72, 482/73

[56] References Cited

U.S. PATENT DOCUMENTS

| | | | |
|---|---|---|---|
| 2,050,652 | 8/1936 | Fleming | 482/140 |
| 4,121,825 | 10/1978 | Hult | 482/140 |
| 4,176,835 | 12/1979 | Aziz | 482/140 |
| 4,182,510 | 1/1980 | Lundell | 482/140 |
| 4,185,816 | 1/1980 | Bernstein | 482/140 |
| 4,468,022 | 8/1984 | Wu | 482/140 |
| 4,591,148 | 3/1986 | Slater | 482/140 |
| 4,593,902 | 6/1986 | Michaelsen | 482/140 |
| 4,602,782 | 7/1986 | Carlson | 482/140 |
| 4,629,179 | 12/1986 | Bizilia | 482/140 |
| 4,679,788 | 7/1987 | Adler | 482/140 |
| 4,705,270 | 11/1987 | Melton | 482/140 |
| 4,809,971 | 3/1989 | Goldish | 482/140 |

*Primary Examiner*—Richard J. Apley
*Assistant Examiner*—Lynne A. Reichard

[57] ABSTRACT

An abdominal exercise bench comprising an elongate upper frame and an auxiliary elongate rectangular base combined together, the upper frame having two semi-round openings for two feet of a user to extend through to hook on the frame, the base having an upper sloped-down surface and a thinner lower end to pass through a gap between the floor and a bottom end of a door, which secures immovable this exercise frame for the user ot take abdominal exercise sitting on the floor with his feet hooked on the upper frame.

3 Claims, 4 Drawing Sheets

ABDOMINAL EXERCISE BENCH

BACKGROUND OF THE INVENTION

Common gym benches or exercise benches are usually immovable, installed on a definite place of large space for people to go there and take exercise on them.

There is a Fleming's patent, which discloses an abdominal exercise bench comprising an upper frame having two arched downwardly facing semi-round openings (23), an upper flat elongate surface (12), a vertical pin hole (24) in a central portion and a combining pin (16). But the exercise bench does not have an auxiliary base shaped as an elongated rectangular plate having an upper sloped down surface that slopes from an upper end to a lower end, a rectangular recess and a plurality of retainer holes, as the present invention does.

Another patent of Adler discloses an abdominal exercise bench comprising an auxiliary base shaped as an elongated rectangular plate, but does not have the same shape as the present invention has an elongated rectangular plate having an upper sloped down surface that slopes from an upper end to a lower end, a rectangular recess and a plurality of retainer holes.

SUMMARY OF THE INVENTION

This invention, an abdominal exercise bench, has been devised to be portable, collapsible and very simple to use.

One feature of this abdominal exercise bench is that it has an upper frame collapsibly combined with an auxiliary base, occupying a very small space after collapsed.

Another feature is that the upper frame has two semi-round openings for two feet of a user to extend through to hook on the upper frame to easily make abdominal exercise sitting on the floor.

One more feature is that the auxiliary elongate rectangular base combined with and under the the upper frame has an upper sloped-down surface, enabling its thinner end to extend through a gap between the floor and a bottom side of a door, which can secure immovably the exercise bench.

DETAILED DESCRIPTION OF THE INVENTION

Figure 1:
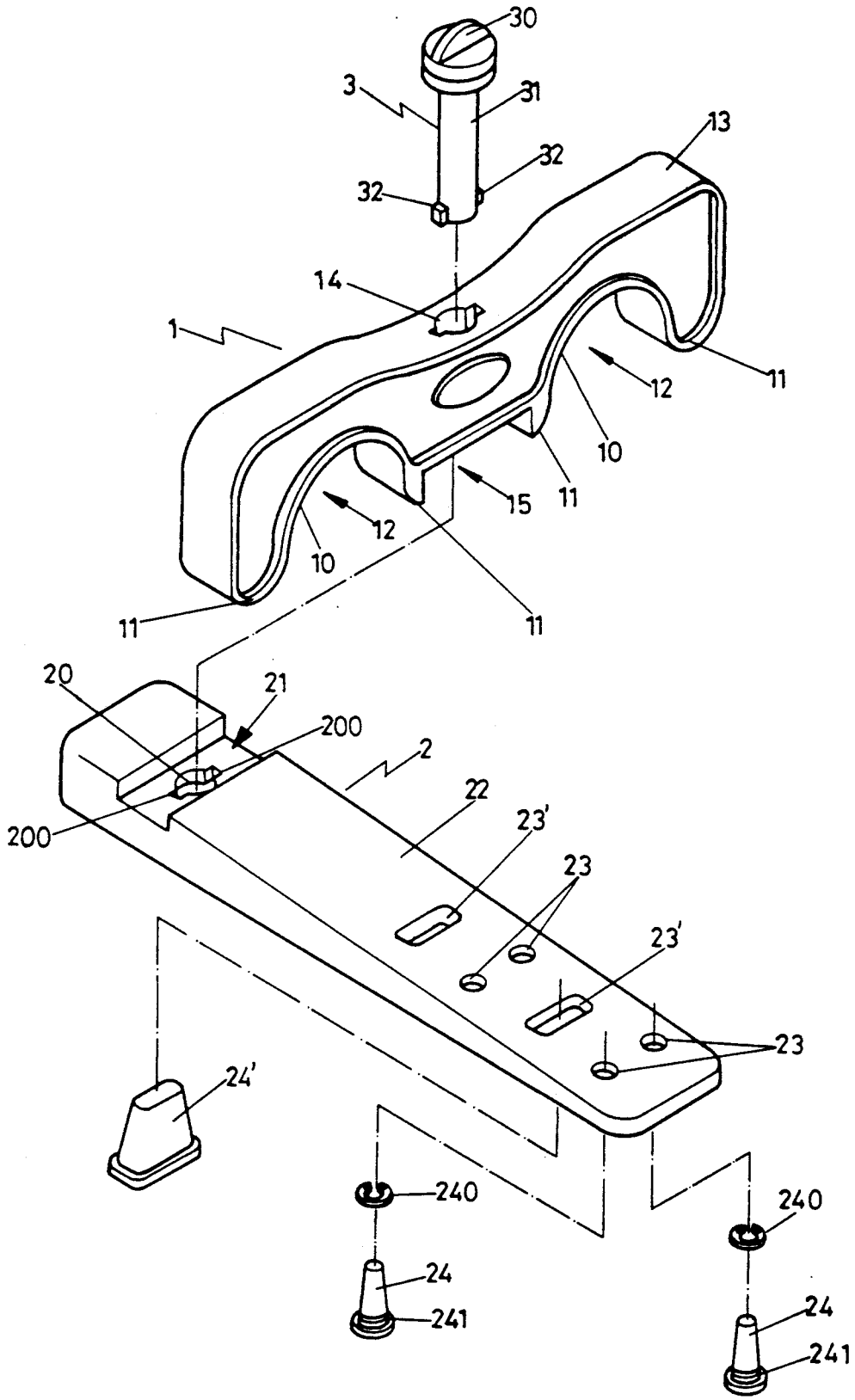
FIG. 1 is an exploded perspective view of a first embodiment of an abdominal exercise bench in the present invention.
Figure 5:
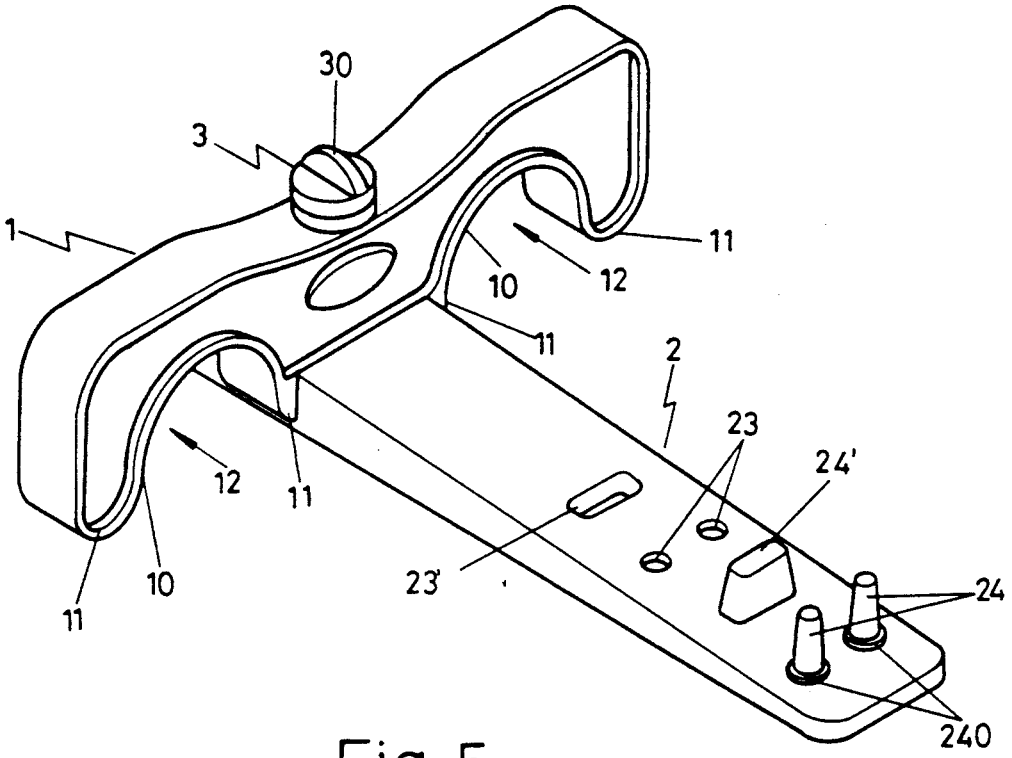
FIG. 5 is a perspective view of the first embodiment of the abdominal exercise bench in the present invention.
Figure 6:
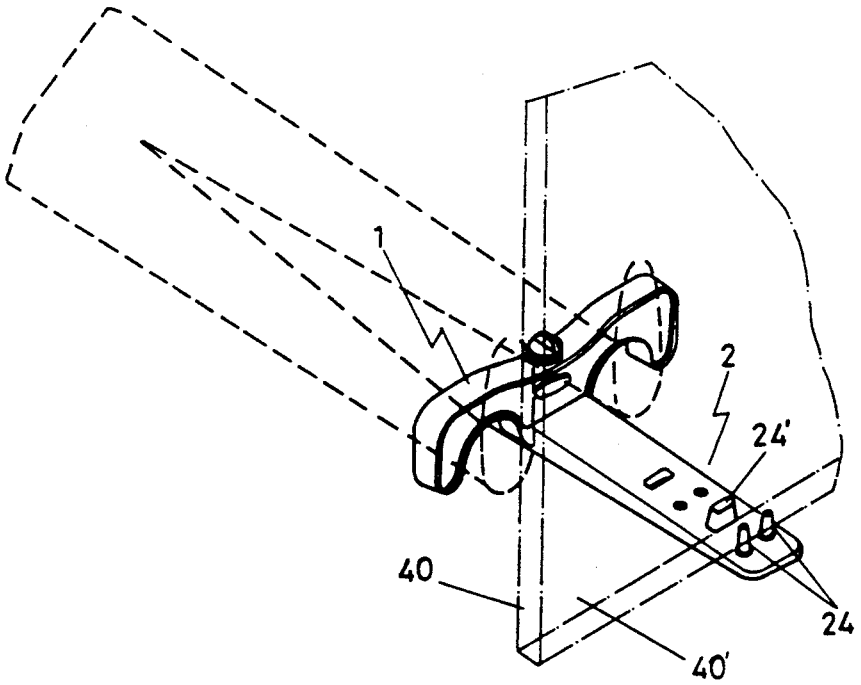
FIG. 6 is a perspective view of the abdominal exercise bench being used in the present invention.

A first embodiment of an abdominal exercise bench in the present invention, as shown in FIGS. 1 and 5, comprises an upper frame 1 and an auxiliary base 2 and a combining pin 3 as main components.

Figure 4:
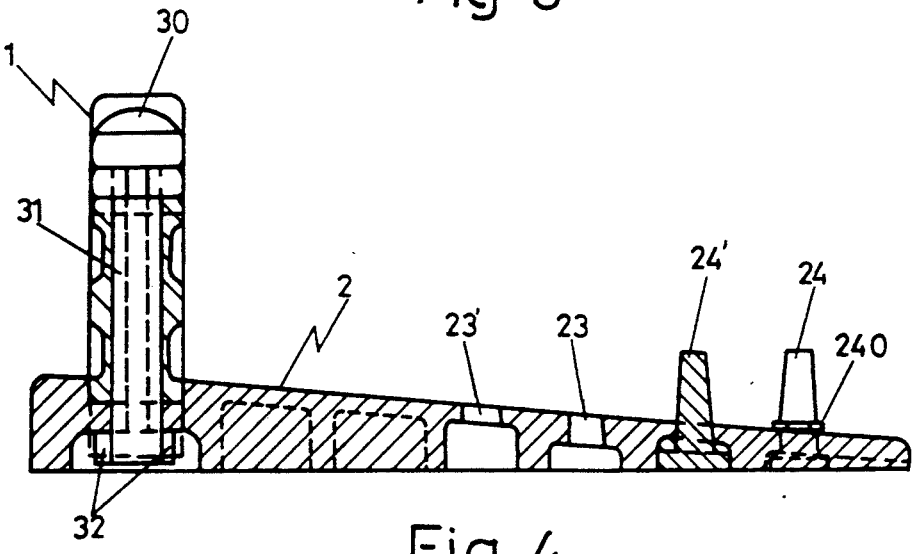
FIG. 4 is a side cross-sectional view of the first embodiment of the abdominal exercise bench in the present invention.

The upper frame 1 has two arched surfaces 10, 10 spaced apart and facing down in a left and a right portion, an outer side wall surface 11, two semi-round openings 12, 12 defined by the two arched surfaces 10, 10, an elongate upper surface 13, a vertical-shaped pin hole 14 in an central portion in line with a pin hole 20 in the auxiliary base 2, and a square opening under the central portion between the two semi-round openings 12, 12 to fit with an inner recess 221 of the auxiliary base 2 in combining the upper frame 1 with the auxiliary base 2 together securely, as shown in FIGS. 4 and 5.

Figure 3:
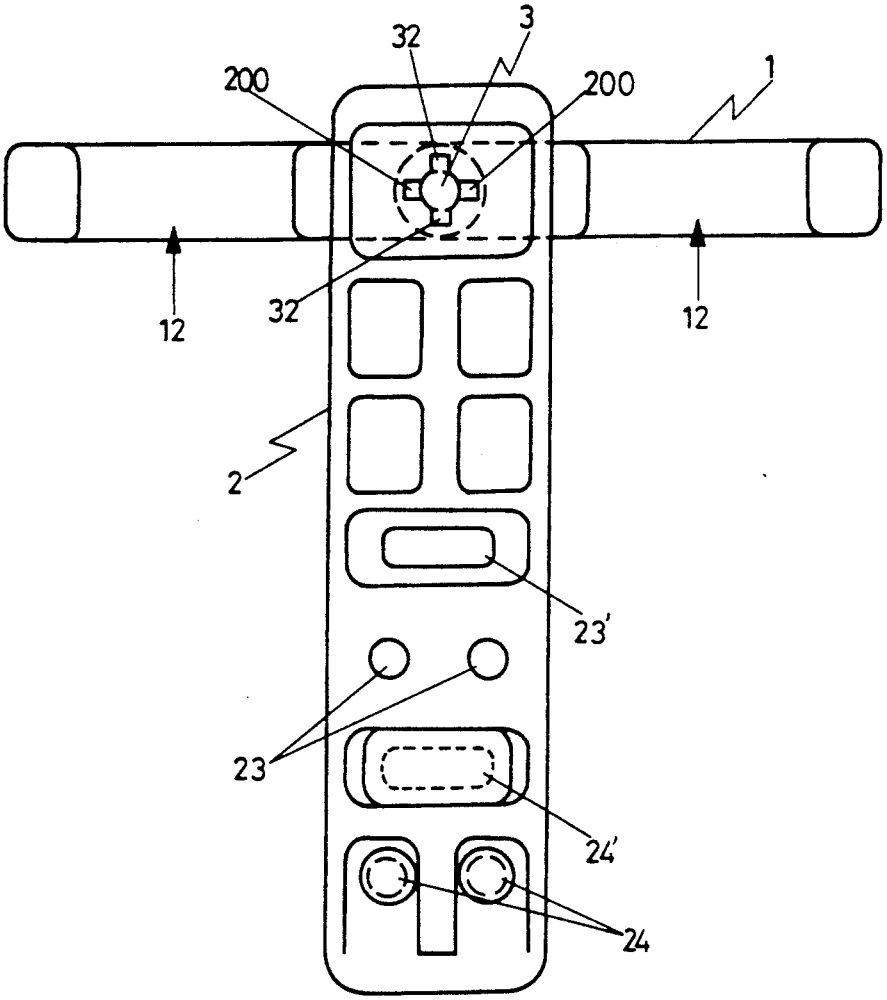
FIG. 3 is a bottom view of the abdominal exercise bench in the present invention.

The auxiliary base 2 is like an elongate rectangular plate, having a sloped upper surface 22 extending from an upper end to a lower end, three pairs of round retainer holes 23, 23 for a pin hole 20 in the center of a rectangular recess 21 three pairs of retainers 24, 24 to engage therein, and a flat bottom surface 25 as shown in FIGS. 3 and 4 provided with a plurality of square recesses 250 to reinforce this base 2 with little possibility of breaking or tearing off.

Figure 2:
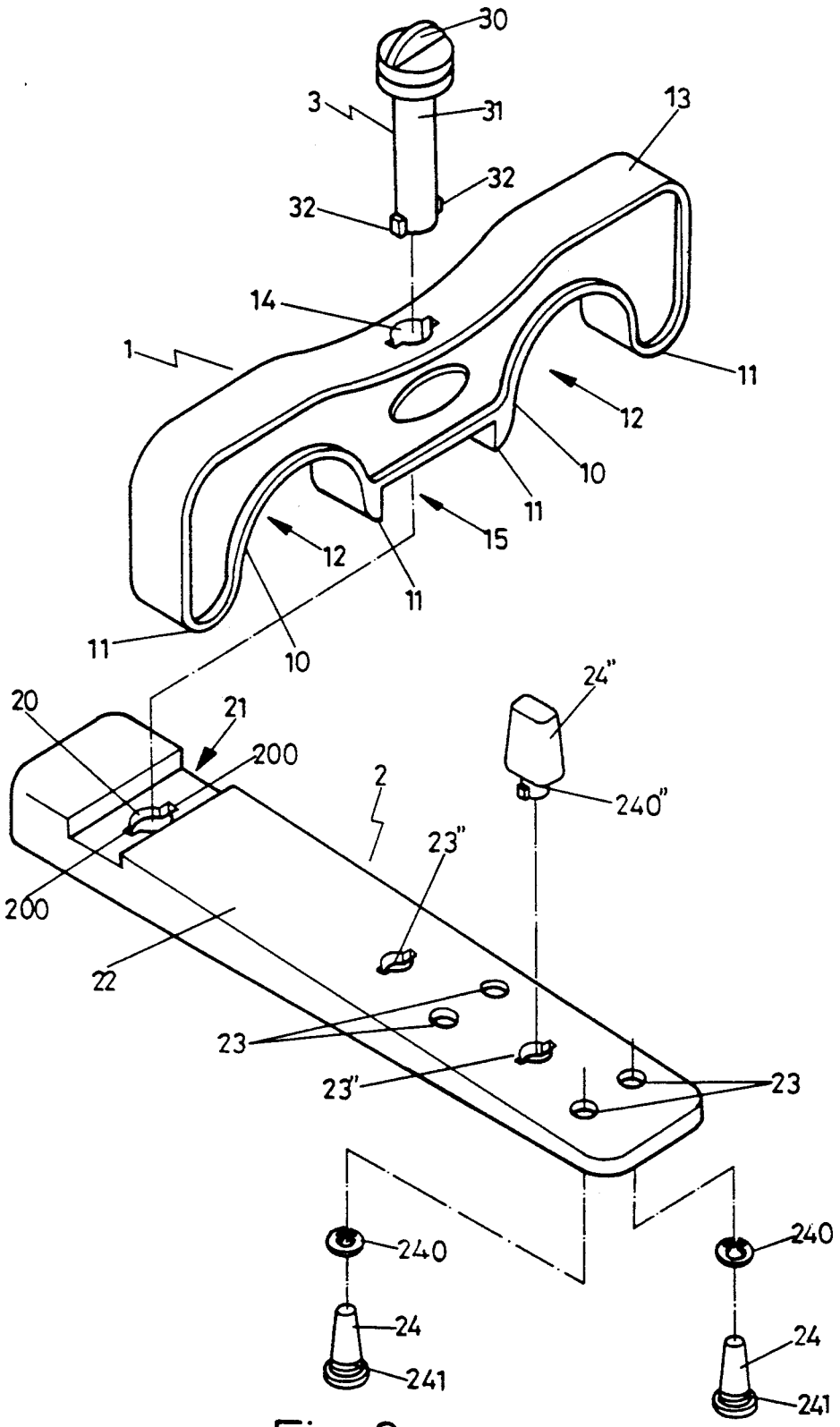
FIG. 2 is an exploded perspective view of a second embodiment of the abdominal exercise bench in the present invention.

The three pairs of the retainers 24, 24 are shaped as conic columns to suit with the round retainer holes 23, 23, inserted up from below and locked by helical spring lock washers 240 fitting in annular grooves 241 in the retainers 24. The retainers 24, 24 can be substituted by those 24" shown in FIG. 2, being inserted down from above, and holes 23" have a shape conforming to a foot 240" of the retainers 24".

The combining pin 3 has a grip projection 30 for fingers to grip for rotating this pin 3, a column 31 extending down from the grip projection 30, and an elastic gasket 32 fitting around an upper portion and two opposite projections 33, 33 extending outward from a bottom end. The combining pin 3 is inserted downward in the pin hole 14, forcing the two projections 33, 33 pass through an inner wall 26, and then through the projection holes 200, 200 in the auxiliary base 2, and then turning the pin 3 for a certain angle to separate the projections 33, 33 from the projection holes 200, 200 so that the upper frame 1 and the auxiliary base 2 can be firmly fixed together.

In suing, the thinner end of the auxciliary base 2 is inserted through a gap 40 between the floor and a bottom side of a door 4, with the retainers 23, 23 standing up beside both door surfaces 40. 40, securing the base 2 immovable. Then, a user extends his two feet through the two semi-round openings 12, 12 of the upper frame 1, and hooks them on the upper frame 1, taking abdominal exercise sitting on the floor.

What is claimed is:

1. An abdominal exercise bench comprising:

an upper frame having at least two arched downwardly facing surfaces spaced apart, two openings defined by the arched surfaces, an upper flat elongate surface, a vertical pin hole in a central portion and a square opening in a lower central portion between said two semi-round openings;

an auxiliary base shaped as an elongated rectangular plate, having an upper surface that slopes downwardly from an upper end to a lower end, a rectangular recess in an upper portion, a pin hole in the center of said rectangular recess, and a plurality of retainer holes in a lower portion for a plurality of retainers to pass through, a flat bottom surface and a plurality of square recesses in the bottom surface;

a combining pin having a grip projection on top and a column extending downward and having an elastic gasket fitting around an upper portion and two opposite projections extending outward from a bottom end to conform to the pin hole in the upper frame; and said two semi-round openings of the upper frame capable of being passed through by two feet of a user, who can hook his two feet on said frame, said auxiliary base being temporarily adapted to be kept immovable by something such as a door, said user hooking his feet on said frame, sitting on the floor for making abdominal exercise.

2. The abdominal exercise bench as claimed in claim 1, wherein said two openings in the upper frame have a semi-round shape capable for human feet to extend through.

3. The abdominal exercise bench as claimed in claim 1, wherein said retainers and said retainer holes have round shape.

* * * * *